US006513683B1

(12) United States Patent
Kull

(10) Patent No.: US 6,513,683 B1
(45) Date of Patent: Feb. 4, 2003

(54) TEAPOT

(76) Inventor: Cheryl R. P. Kull, 10595 Bell Rd., Duluth, GA (US) 30097

( * ) Notice: Subject to any disclaimer, the term of this patent is extended or adjusted under 35 U.S.C. 154(b) by 0 days.

(21) Appl. No.: 10/083,046

(22) Filed: Feb. 26, 2002

(51) Int. Cl.[7] ..... A47G 19/14
(52) U.S. Cl. ..... 222/465.1; 222/470; 220/592.22; 220/916
(58) Field of Search ..... 222/465.1, 470–472; 220/592.22, 916

(56) References Cited

U.S. PATENT DOCUMENTS 2,501,142 A * 3/1950 Reichart ..... 222/470
3,130,881 A * 4/1964 Jepson ..... 222/470
6,006,959 A * 12/1999 Naden et al. ..... 220/472
6,142,325 A * 11/2000 Chomik ..... 220/916

* cited by examiner

*Primary Examiner*—Philippe Derakshani
(74) *Attorney, Agent, or Firm*—Joseph N. Breaux

(57) ABSTRACT

An improved teapot constructed from materials including thermal insulating materials. The improved teapot is easily cleaned and has an exterior fashioned in an aesthetically pleasing manner. A sealing mechanism if provided for sealing a tea holding cavity ad maintaining the tea within the holding cavity at an optimal serving temperature for as long as possible.

4 Claims, 2 Drawing Sheets

TEAPOT

TECHNICAL FIELD

The present invention relates to beverage serving devices and more particularly to an improved teapot that includes a pot structure, a screw in bottom sealing member, and a screw in lid that together define a tea holding cavity therein; the pot structure, the screw in bottom sealing member, and the screw in lid all being formed from thermally insulating material; a spout also formed from thermal insulating material being in fluid connection with the tea holding cavity; the spout being sealable by a friction fit cap placed over the spout end; the spout being in fluid connection with the tea holding cavity through a valve mechanism wherein the valve mechanism is moveable between a closed position blocking fluid flow between the tea holding cavity and the spout and a fully open position wherein a fluid pathway is provided for allowing the free flow of fluid between the tea holding cavity and the spout; the valve mechanism being optionally actuated by a mechanical linkage including a teapot handle mounted release button; an electronic valve actuator activated by a teapot handle mounted activation switch; or a mechanical valve positioning lever provided on the spout in direct connection with the valve mechanism.

BACKGROUND ART

Many individuals enjoy drinking hot tea but find it difficult to brew the tea properly and/or to maintain the tea at a proper temperature for serving for a reasonable period of time. It would be desirable, therefore, to have a teapot that was constructed from thermally insulating materials that would be easily cleaned, and constructed from materials that allowed the exterior to be fashioned in an aesthetically pleasing manner. As an aid in maintaining the tea at an optimal serving temperature for an extended period, it would be a further benefit to have one or more sealing mechanisms for sealing a tea dispensing fluid passageway between a tea holding cavity within the teapot and the pouring spout until just before and right after a quantity of tea was poured. A friction fit spout sealing cap is preferably a first mechanism for sealing the spout. A secondary sealing mechanism would desirably be a valve positioned between the tea holding cavity and the spout. To facilitate unsealing of the valve, it would be a further benefit to have an electronic or mechanical valve operating mechanism actuated by a actuator provided on the teapot handle. The mechanical valve may also be actuated by a lever placed at the spout end of the teapot if desired.

GENERAL SUMMARY DISCUSSION OF INVENTION

It is thus an object of the invention to provide an improved teapot that includes a pot structure, a screw in bottom sealing member, and a screw in lid that together define a tea holding cavity therein; the pot structure, the screw in bottom sealing member, and the screw in lid all being formed from thermally insulating material; a spout also formed from thermal insulating material being in fluid connection with the tea holding cavity; the spout being sealable by a friction fit cap placed over the spout end; the spout being in fluid connection with the tea holding cavity through a valve mechanism wherein the valve mechanism is moveable between a closed position blocking fluid flow between the tea holding cavity and the spout and a fully open position wherein a fluid pathway is provided for allowing the free flow of fluid between the tea holding cavity and the spout; the valve mechanism being optionally actuated by a mechanical linkage including a teapot handle mounted release button; an electronic valve actuator activated by a teapot handle mounted activation switch; or a mechanical valve positioning lever provided on the spout in direct connection with the valve mechanism.

Accordingly, an improved teapot is provided. The improved teapot includes a pot structure, a screw in bottom sealing member, and a screw in lid that together define a tea holding cavity therein; the pot structure, the screw in bottom sealing member, and the screw in lid all being formed from thermally insulating material; a spout also formed from thermal insulating material being in fluid connection with the tea holding cavity; the spout being sealable by a friction fit cap placed over the spout end; the spout being in fluid connection with the tea holding cavity through a valve mechanism wherein the valve mechanism is moveable between a closed position blocking fluid flow between the tea holding cavity and the spout and a fully open position wherein a fluid pathway is provided for allowing the free flow of fluid between the tea holding cavity and the spout; the valve mechanism being optionally actuated by a mechanical linkage including a teapot handle mounted release button; an electronic valve actuator activated by a teapot handle mounted activation switch; or a mechanical valve positioning lever provided on the spout in direct connection with the valve mechanism.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

EXEMPLARY MODE FOR CARRYING OUT THE INVENTION

Figure 1:
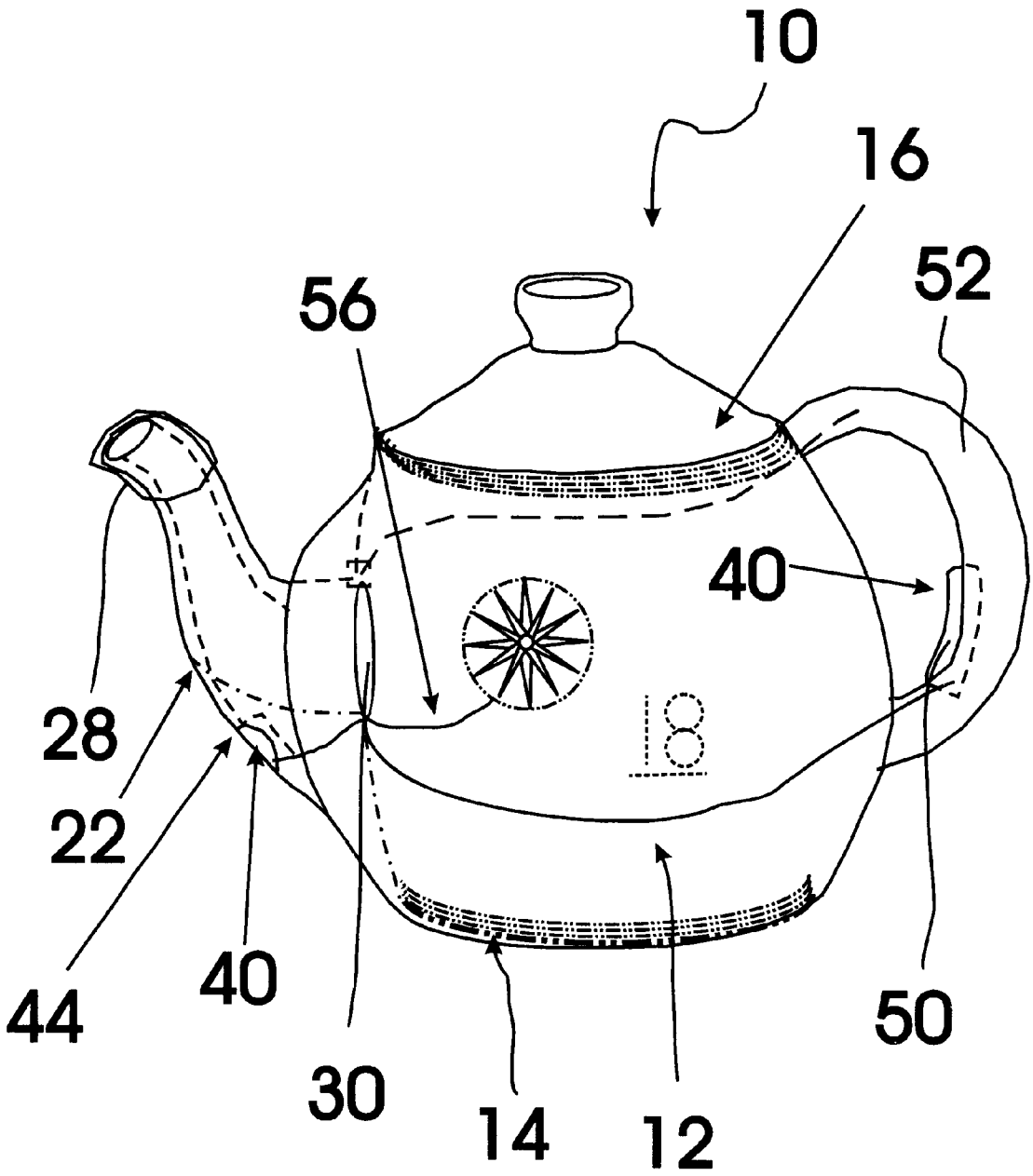
FIG. 1 is a perspective view of a first exemplary embodiment of the improved teapot of the present invention.
Figure 2:
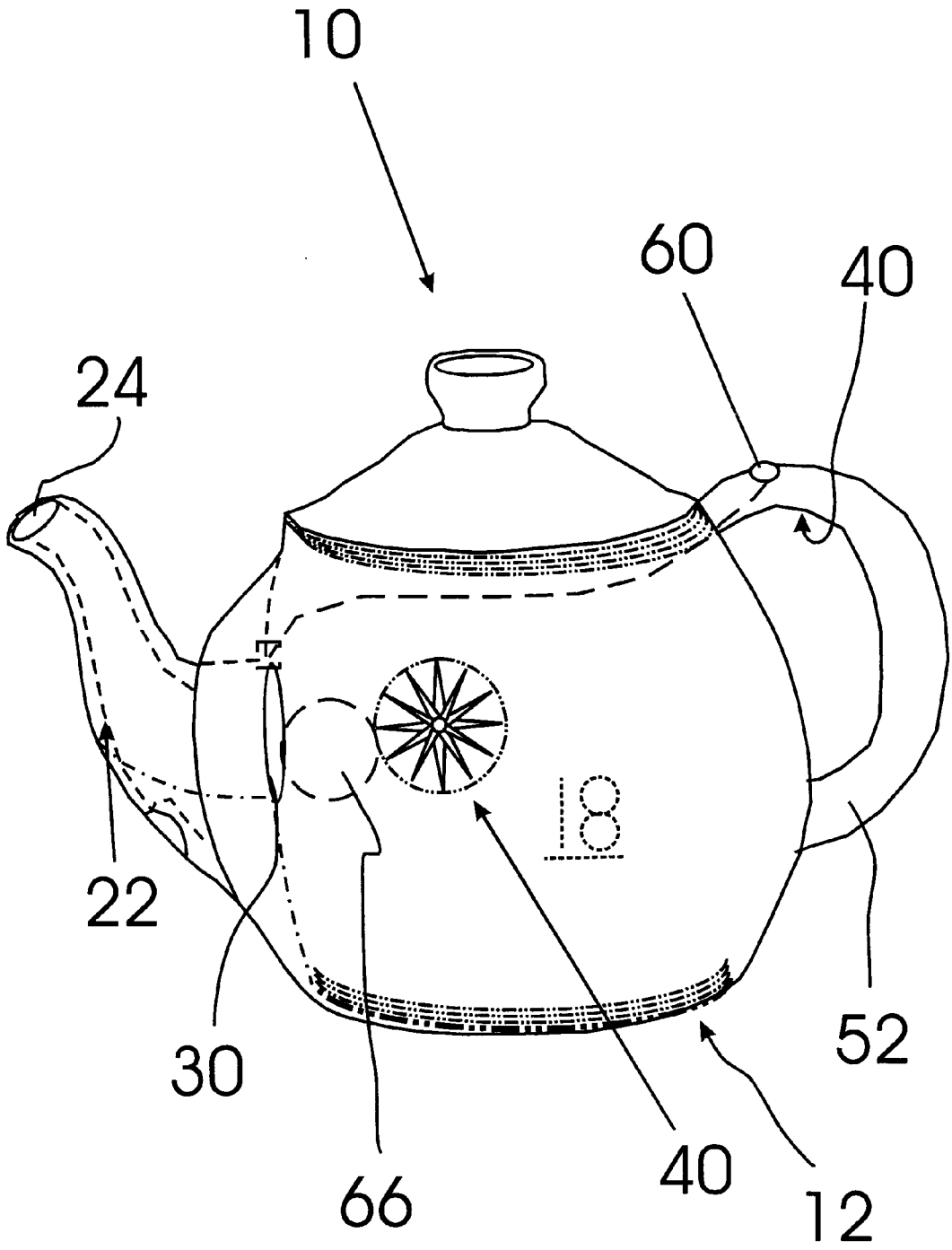
FIG. 2 is a perspective view of a second exemplary embodiment of the improved teapot of the present invention.

FIG. 1 shows various aspects of an exemplary embodiment of the improved teapot of the present invention generally designated 10.

Improved teapot 10 includes a pot structure, generally designated 12; a screw in bottom sealing member, generally designated 14; and a screw in lid, generally 16; that together define a tea holding cavity, generally 18, therein.

Pot structure 12, screw in bottom sealing member 14, and screw in lid 16 are all formed from thermally insulating plastic material covered with a finely decorated, delicate porcelain outer surface. A spout, generally designated 22, is formed from the thermal insulating plastic (any thermal insulating material may be used) covered porcelain and is in fluid connection with the tea holding cavity 18.

Spout 22 has a open end 24 that is sealable by a friction fit, insulating cap 28 cap placed over spout open end 24 when tea is not being poured from cavity 18. Spout 22 is in fluid connection with the tea holding cavity 18 through a valve mechanism, generally designated 30 (shown in dashed lines) wherein the valve mechanism 30 is moveable between a closed position blocking fluid flow between the tea holding cavity 18 and the spout and open end 24 of spout 22 and another position wherein a fluid pathway is provided for allowing the free flow of fluid between the tea holding cavity 18 and the spout open end 24.

Valve mechanism 30 is operable through the use of any of a number of valve manipulating mechanisms, generally designated 40. Some exemplary valve manipulating mechanisms include providing a mechanical linkage 44 on the spout that opens valve 40 when the linkage 44 is depressed. Another valve manipulating mechanism 40 includes providing a release button 50 on a teapot handle portion 52 that is electronically linked to an electronic valve actuator 56 which moves valve mechanism 40 into the open position when release button 50 is depressed.

Yet another valve manipulating mechanism 40 includes providing a transmitter activation button 60 on handle 52 and providing a receiver 66 on the electronic valve actuator 56 which moves valve mechanism 40 into the open position when transmitter activation button 60 is depressed.

It can be seen from the preceding description that an improved teapot has been provided that provides a decorative teapot that maintains a quantity of tea at the proper serving temperature for an extended period of time has been provided.

It is noted that the embodiment of the improved teapot described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in limiting sense.

What is claimed is:

1. An improved teapot comprising:

a pot structure having a handle provided thereon;

a screw in bottom sealing member;

a spout; and a screw in lid that together define a tea holding cavity therein; the pot structure, the screw in bottom sealing member, the spout and the screw in lid all being formed from thermally insulating material;

the spout be in fluid connection with the tea holding cavity;

the spout being sealable by a provided, friction fit cap that is positionable over an open end of the spout;

the spout being in fluid connection with the tea holding cavity through a valve mechanism wherein the valve mechanism is moveable between a closed position blocking fluid flow between the tea holding cavity and the spout and an open position wherein a fluid pathway is provided for allowing the flow of fluid between the tea holding cavity and the open end of the spout;

the valve mechanism being actuated by use of a valve manipulating mechanism accessible to the user from the exterior of the improved teapot.

2. The improved teapot of claim 1 wherein:

the valve manipulating mechanism includes a mechanical linkage between the valve mechanism and a teapot handle mounted release button.

3. The improved teapot of claim 1 wherein:

the valve manipulating mechanism includes an electronic electronic valve actuator that is activated by operation of an activation switch positioned on the improved teapot.

4. The improved teapot of claim 1 wherein:

the valve manipulating mechanism includes a direct mechanical linkage between the valve mechanism and a valve positioning lever extending from the spout of the improved teapot.

* * * * *